US006778947B1

(12) United States Patent
Danzler

(10) Patent No.: US 6,778,947 B1
(45) Date of Patent: Aug. 17, 2004

(54) METHOD FOR DESIGNING AND/OR VISUALIZING AT LEAST ONE ROLL/FELT PAIR IN A PAPER OR CARTON MAKING MACHINE PRESS

(75) Inventor: Franz Danzler, St. Valentin (AT)

(73) Assignee: Stowe Woodward AG (DE)

( * ) Notice: Subject to any disclaimer, the term of this patent is extended or adjusted under 35 U.S.C. 154(b) by 0 days.

(21) Appl. No.: 09/380,238

(22) PCT Filed: Feb. 28, 1997

(86) PCT No.: PCT/EP97/01016

§ 371 (c)(1),
(2), (4) Date: Nov. 15, 1999

(87) PCT Pub. No.: WO98/38383

PCT Pub. Date: Sep. 3, 1998

(51) Int. Cl.[7] ..... G06G 7/48
(52) U.S. Cl. ..... 703/6; 345/961; 700/83
(58) Field of Search ..... 703/6; 162/198; 700/122, 127, 128, 129, 83; 345/961, 964, 965, 970, 839

(56) References Cited

U.S. PATENT DOCUMENTS 4,427,734 A * 1/1984 Johnson ..... 442/324
4,581,095 A * 4/1986 Schommler ..... 156/210
4,639,881 A * 1/1987 Zingher ..... 345/839
4,880,499 A * 11/1989 Pikulik ..... 162/198
4,885,785 A * 12/1989 Reynolds et al. ..... 101/226
4,984,773 A * 1/1991 Balban et al. ..... 101/181
5,135,802 A * 8/1992 Gstrein et al. ..... 139/383 A
5,358,606 A * 10/1994 Makkonen ..... 203/57
5,713,396 A * 2/1998 Lee ..... 139/383 A
5,718,060 A * 2/1998 Mori ..... 34/446
5,784,963 A * 7/1998 Schmid ..... 101/424
5,792,320 A * 8/1998 Kaasalainen et al. ..... 162/205
5,853,543 A * 12/1998 Hu et al. ..... 162/198
5,891,306 A * 4/1999 Chase et al. ..... 162/198
6,024,835 A * 2/2000 Fiore et al. ..... 162/198
6,077,397 A * 6/2000 Shipley ..... 139/383 A

OTHER PUBLICATIONS

The Visual Display of Quantitative Information, Edward Tufte, Graphics Press, 1983, pp. 28–29, and 40–41.*
Perry's Chemical Engineer's Handbook, 1997, Section 8, Process Control, pp. 8–1 to 8–31.*

* cited by examiner

*Primary Examiner*—Kevin J. Teska
*Assistant Examiner*—Ed Garcia-Otero
(74) *Attorney, Agent, or Firm*—Myers Bigel Sibley & Sajovec, P.A.

(57) ABSTRACT

This invention is directed to a method of designing and/or visualizing at least one roll/felt combination in the wet press of a paper or cardboard making machine, wherein initially a press configuration is selected from a set offered by a computer system. Thereafter, one of the presses of the respective press configuration is selected. Thereupon the current dewatering performance of the selected press is calculated and the result if displayed. Thereafter, the machine parameters and/or roll parameters of the respective selected press are altered while the dewatering performance of the respective roll/felt combination of the press is continuously calculated anew and is displayed at least in part as a trend indication.

13 Claims, 16 Drawing Sheets

Fig 4

DRAINMASTER
roll analysis

| | |
|---|---|
| customer | customer 1 |
| paper machine | PM 1, 1st press |
| comment | sample for manual |

| degree of beating | 65,00 |
|---|---|
| mechanical wood pulp (%) | 5,00 |
| pine sulfate (%) | 0,00 |
| beech sulfite (%) | 0,00 |
| spruce sulfite (%) | 0,00 |
| waste paper (%) | 50,00 |
| thermo-mechanical pulp (%) | 35,00 |
| filler (%) | 10,00 |

machine parameters

PM v (m/min): 0,0 / 1000,0 / 2000; 1500

LL (kN/m): 150,0 / 100,0 / 0,0; 75

| | | |
|---|---|---|
| Newsprint | 45 | g/m² |
| input dry content | 20,0 | % |
| stock temperature | 55 | °C |

roll parameters length of covering (m) 9,2 number of nips 2

| | upper roll | lower roll |
|---|---|---|
| kind of covering | polyurethane | steel |
| plastometer point P&J | 10 | 0 |
| thinkness of covering (mm) | 20,0 | |
| diameter (mm) | 1640,00 | 1125,00 |
| flute | 0,70 | 0,40 |
| ridge | 2,50 | 1,60 |
| depth | 2,00 | 4,00 |
| diameter of blind bore | 0,00 | 0,00 |
| blind bore depth | 0,00 | 0,00 |
| open area blind bore % | 0,00 | 0,00 |
| diameter suction hole | 4,00 | 0,00 |
| open area suction hole % | 16,87 | 0,00 |
| total open area % | 35,05 | 20,00 |
| H2O volume of roll ml/m² | 1044 | 800 |

results

| | |
|---|---|
| | 27,4 |
| H2O from paper | 61 |
| total H2O ml/m² | 1341 |
| overall storage volume (ml/m²) | 2448 |
| H2O difference | 1107 |
| width of gap (mm) | 25,8 |
| maximum pressure (Mpa) | 3,7 |
| average pressure (Mpa) | 2,9 |
| dwell time (ms) | 1,0 |
| spec. speed (U/s) | 9,7 |
| depth of impression (mm) | 0,25 |
| temperature build-up (°C) | 23,2 |
| press pulse (kPas) | 3,0 |
| coolant l/min | 235,96 oil |

Fig 7

DRAINMASTER
roll analysis

| | |
|---|---|
| customer | customer 1 |
| paper machine | PM 1, 1st press |
| comment | sample for manual |

| | |
|---|---|
| **degree of beating** | 65,00 |
| mechanical wood pulp (%) | 5,00 |
| pine sulfate (%) | 0,00 |
| beech sulfite (%) | 0,00 |
| spruce sulfite (%) | 0,00 |
| waste paper (%) | 50,00 |
| thermo-mechanical pulp (%) | 35,00 |
| filler (%) | 10,00 |

machine parameters

PM v (m/min): 0,0 – 1000,0 – 2000; 1500

LL (kN/m): 150,0 – 100,0 – 0,0; 75

| | | |
|---|---|---|
| Newsprint | 45 | g/m² |
| input dry content | 20,0 | % |
| stock temperature | 55 | °C |

roll parameters length of covering (m) 9,2 number of nips 2

| | upper roll | lower roll |
|---|---|---|
| kind of covering | polyurethane | steel |
| plastometer point P&J | 10 | 0 |
| thinkness of covering (mm) | 20,0 | |
| diameter (mm) | 1640,00 | 1125,00 |
| flute | 0,70 | 0,40 |
| ridge | 2,50 | 1,60 |
| depth | 2,00 | 4,00 |
| diameter of blind bore | 0,00 | 0,00 |
| blind bore depth | 0,00 | 0,00 |
| open area blind bore % | 0,00 | 0,00 |
| diameter suction hole | 4,00 | 0,00 |
| open area suction hole % | 16,87 | 0,00 |
| total open area % | 35,05 | 20,00 |
| H2O volume of roll ml/m² | 1044 | 800 |

results

| | |
|---|---|
| | 27,4 |
| H2O from paper | 61 |
| total H2O ml/m² | 1341 |
| overall storage volume (ml/m²) | 2448 |
| H2O difference | 1107 |
| width of gap (mm) | 25,8 |
| maximum pressure (Mpa) | 3,7 |
| average pressure (Mpa) | 2,9 |
| dwell time (ms) | 1,0 |
| spec. speed (U/s) | 9,7 |
| depth of impression (mm) | 0,25 |
| temperature build-up (°C) | 23,2 |
| press pulse (kPas) | 3,0 |
| coolant l/min 235,96 | oil |

METHOD FOR DESIGNING AND/OR VISUALIZING AT LEAST ONE ROLL/FELT PAIR IN A PAPER OR CARTON MAKING MACHINE PRESS

This invention is directed to a method of designing and/or visualizing at least one roll/felt combination in the wet press of a paper or cardboard making machine. DE 38 35 641 A1 discloses a method of controlling and/or monitoring the drying process of a paper or cardboard web.

In this method, the air distribution system of a so-called yankee cylinder is triply divided, and a computer is used to control the drying process. Controlling and monitoring the drying process of the yankee cylinder is carried out on the basis of an on-line simulation program with the intention of achieving improved paper quality and more effective drying both in respect of energy consumption and of the actual drying process. To this end a process model is utilized which was established on the basis of trial runs, on-line measurements and/or the drying theory. From a so-called type file or recipe file, set-point parameters in accordance with the web types to be run are entered into the process model, and at predetermined time intervals the simulation program is provided with fresh initial values which are supplied by measuring transducers of the drying process. It is stated that thereby the disclosed process model is adaptive. Hence, the known simulation program will calculate, for instance, the evaporative capacity for every segment of the web to be dried, the dry content and temperature of the paper as well as the energy consumption of the individual drying segments on the basis of the initial values. Additionally, it is possible to determine the velocity, humidity and temperature of the blow air.

In contrast with the drying method disclosed in DE 38 35 641 A1 with air flows directed against the web, there are paper making machines including dewatering members which comprise wet press felts, drying screens, and rolls. By means of wet pressing, as it is called, the paper or cardboard web is drained or dewatered in controlled fashion, the respective machine covering governing the quality of the finished products, the smooth running of the press, and the service life of the felts.

In this respect, the performance of the covering within the press is dependent on the defined roll configuration which in its turn interacts with the felt material.

The alternating effects and influencing parameters of roll/felt combinations in wet presses are extremely complex, and undesirable and unforeseeable alterations in quality or undesirable limitations in productivity during operation of the paper making machines will result due to clogging of the felt in operation. Prior known designing methods in respect of configuring an optimum roll/felt combination rely on sometimes extensive test runs and investigations of modifications necessary on site at the customer's plant, but such investigations are highly time-consuming and costly.

It is therefore the object of the present invention to provide a method of designing and/or visualizing at least one roll/felt combination in the wet press of a paper or cardboard making machine, said method being capable of acquiring the complex processes in the wet press under consideration of the existing multiplicity of influencing parameters and to represent these processes in a simple and clear way, and particularly customer-specific initial approximations in respect of critical problems of felt design should be capable of being found with a view to optimum efforts in time and costs. The method according to the present invention endeavors to achieve decisions concerning application technology within shorter time periods, wherein operations may be predicted, visualized and tested direct on site, for instance when advising the customer or with already existing plants. Additionally, an analysis of problems that may occur should be executable by means of the invention in a fast and cost-efficient way.

The object of the invention is solved with a method as set out in the teachings of claim 1, and the dependent claims comprise at least suitable embodiments and further developments thereof.

The basic idea of the present invention resides in performing a functional analysis of individual roll/felt combinations of presses with reference to a standard database and to predetermined, easily visualizable known press configurations while in the first place not requiring individual considerations in respect of the multiplicity of complex parameters characteristic for the wet pressing and drying process.

To this end, computing steps for showing the result are shifted to the background particularly when there exist altered input parameters, while the execution of the required arithmetic operations occurs nearly simultaneously, so that a feedback of altered parameters in respect of the dewatering capacity and the performance of the wet press may at any time be fetched for analysis, and especially also process-related analysis.

From a set of offered press configurations the present method accordingly selects the respective actual configuration that is to be designed or visualized, wherein additionally the respective application and the desired paper or cardboard quality may be considered as a criterion governing the selection.

Subsequently, within the selected press configuration, a press, i.e. a roll/felt combination, will be selected and relevant initial machine and roll parameters of the selected press will be read and displayed in the internal database.

Due to the reading of database standard parameters a reasonable set of data will be available for starting the designing process while actual technical facts are taken into consideration.

Due to the fact that the database is updated in the sense of a self-learning process, as will be possible in an advantageous embodiment of the present invention, the method will be qualified in the course of its application so that by making use of the existing computer system, the inputting efforts will be further reduced, on the one hand, and the meaningful content of the displayed results will be enhanced, on the other hand.

On account of a multiplicity of spreadsheet-like allocations of standard parameters and results to be displayed upon reference to these standard parameters, the respective arithmetic efforts are reduced. In other words, a recalculation of results has to be executed only upon a change of the input parameters provided there are no previously calculated results for these input parameters present in the database. This measure renders the method according to the invention suitable for on-line process control so that it may accordingly also be used for continuously monitoring and controlling wet presses in paper and cardboard making machines.

After calculation and display of the results relating to the current dewatering performance of the respective selected press it will be possible to make a controlled alteration of machine and/or roll parameters of the selected press.

It is an essential feature of the present invention that the reading of relevant felt parameters to be allocated already starts when reading or re-writing machine and roll parameters from the and into the standard database, respectively.

Such reading of felt parameters, or also a calculation of values characteristic for the dewatering performance is always executed in the background. It is possible by means of such background calculations to minimize the amount of image data required for visualization, on the one hand, and to provide in good time the connection between the properties of roll and felt, i.e. the concrete roll/felt combination, which is required for displaying the result, on the other hand.

Due to the felt and roll analysis which is performed in quasi-parallel fashion and the separate displaying of the respective analysis results under consideration of the values required for the interaction between the paired combination, the otherwise hardly recognizable performance of the wet press is more easily represented. In particular, due to the well arranged representation it is more easily possible in respect of the controlling and monitoring tasks to recognize countermeasures more readily when an alarm is being triggered due to limit conditions of the dewatering process having been reached, so that the proper measures for eliminating any hydraulic overload on the system may be introduced as quickly as possible.

Subsequently, the change in machine and/or roll parameters of the selected press required for the design of the roll/felt combination will then, due to the changes in parameters, lead to an altered dewatering performance of the roll/felt combination of the press, such performance being continuously calculated anew and displayed at least in part as a trend display.

Due to the above-mentioned simultaneous existence of the arithmetic results, switching between roll and felt analysis may be done at random, wherein each presentation of results is provided with input areas for renewed altering and setting of machines and rolls or of machine and felt parameters.

In a preferred embodiment of the method according to the present invention, continuous altering and setting of machine, roll, and/or roll/felt parameters is automatically performed with the intention to provide for any press configuration a roll/felt combination and/or a non-woven felt structure that is distinguished by a predetermined maximum dewatering capacity.

In this embodiment of the method a calculating cycle is triggered at the input side, in which the computer system automatically starts to execute the designing procedure right through until limit values or limit loads are reached, and the obtained results are displayed.

The above-described method is repeated for further presses of the respective press configuration, in which system-proposed data for the further presses are read from the standard database. Essential machine parameters as well as stock parameters which govern the quality of the paper or cardboard will be maintained as higher ranking influencing parameters and will be taken over until a new press configuration is selected.

The standard database, which for instance is based on experience or on previously calculated values, includes linked presetting data for all press configurations, but these data may be changed in the analysis or design process in respect of the roll/felt combination. It is within the scope of the invention that values obtained by calculation on the basis of new machine, stock, roll and/or felt parameters and characteristic of the respective pairing may be stored as new standard data and may be included within the standard database. Establishing new standard data may be realized by an updating operation by the execution of self-learning steps.

To enhance the visualization of the obtained results or the displayed parameters, these may be displayed on the monitor of the computer system in different graphic and/or colored form. In a specific embodiment, the dewatering performance of the respective press is represented by a display of the product-related results in a first corresponding form, of the water-related results in a second corresponding form, and of the variable input parameters in a third corresponding form.

With the method according to the present invention it is possible by means of a few simple inputting operations and by reference to a computer system to represent complex procedures in the wet press of a paper or cardboard making machine, wherein a great number of influencing parameters may be recorded which are, however, presented in simple form so that even under consideration of the important interactions between individual parameters the distinctiveness of the display will be retained.

Due to the parallel running of roll and felt analysis which is, however, always kept in the background, random switching between displays is possible while the original input values of the respective press are retained. A controlled change of the stock or machine parameters may be executed both from the roll analysis and from the felt analysis, i.e. after calling the respective submenu.

When selecting a further press of a press configuration, the system starts with a system proposal in respect of the new roll/felt combination, while essential machine and stock parameters are taken over. These parameters, especially the machine speed, the paper quality, the stock temperature and other stock parameters, will be retained for all presses of the configuration until a modification of these higher-ranking influencing parameters is effected.

By the present method it is possible in a very simple way to find out what effects an increase in pulp temperature, a change in line-load, a change in machine speed, stock feed or degree of beating will have on the ultimate dry content of the paper or cardboard. Likewise, immediate visualization of the effects of an increase in speed, for instance as related to the loss of dry content, will be possible.

Another advantage of the method resides in the process-related simulation of the performance of the roll/felt combination, especially the long-term performance of the felt under consideration of clogging of the felt surface, so that the time period of maximum felt capacity and the timing for maintenance work may be determined already prior to a resulting deterioration in quality such as, for instance, crushed paper. Finally, it is possible to choose from among the set of calculated results a subset for displaying limit conditions during the dewatering process. These limit conditions are, in particular, a maximum pressure of the press resulting from the properties of roll linings which are for instance elastomeric, a negative water balance, or an excessively high resistance to flow within the felt possibly leading to hydraulic overloading and resultant vibrations, a short useful life of the felt and felt breakage.

The present invention will be explained in detail by way of an embodiment thereof and with reference to the drawings.

In the drawings:

FIGS. 2 to 8 are screen presentations of the roll analysis including the symbolic link between influencing parameters and results.

Figure 1:
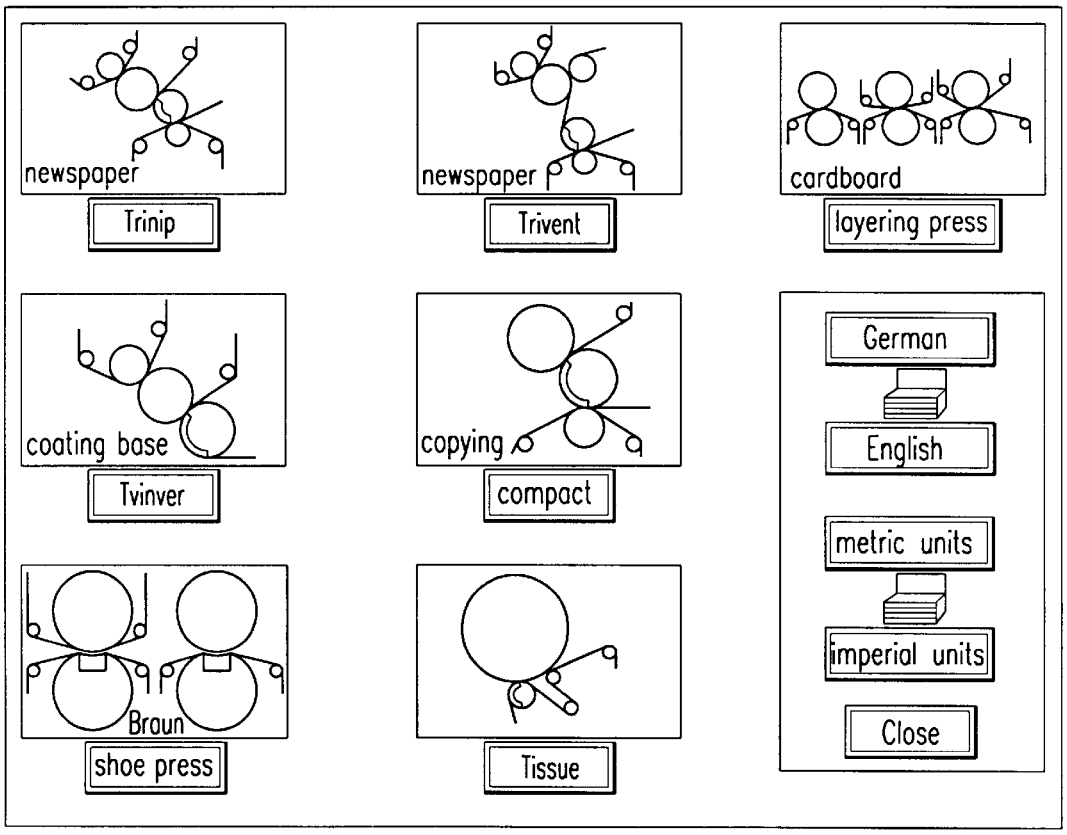
FIG. 1 is a view of the opening or main menu for performing the method by means of a computer system.

The main menu shown in FIG. 1 illustrates frequent applications of various press configurations, wherein the respective press image additionally shows the paper grade of the standard setting. In the area beneath the respective press image the type of press is specified, in which for instance Trinip, Tvinver, Trivent, compact, tissue, shoe and layering presses are mentioned. Each designation area allows opening of the respective menu by a usual click, for instance with a computer mouse. Likewise, it is possible to select from the main menu both a language and the system of units to be used.

By way of the main menu, selection of the press configurations such as Trinip, is performed and in a subsequent step the respective press and the machine direction may additionally be selected.

During this selection of a press, for instance the first press, the program for a newspaper printing paper machine is fetched, and the first press of a Trinip press configuration is displayed with all relevant parameters by reference to a standard database. Relevant parameters concern the rolls, the felts used, the feed stock and so forth.

As will be apparent from FIGS. 2 to 8, upon opening of the corresponding menu there results a worksheet relating to the roll analysis which in addition to relevant customer information comprises an internal designation, "paper machine PM 1, $1^{st}$ press" in the case. In the upper right-hand menu display, the by stock parameters, i.e. the properties of the stock are displayed, in which the ab, breviation AP means 'used paper content', and TMP means thermo-mechanical pulp. The specification of the fillers is related to the charge of clay, CaO, $CaCO_3$ or the like. The values specified in the machine parameter field comprise in the left-hand portion of the display a speed of the paper making machine in rn/mm represented as analog vector image with digital numerical display, the line-load (LL) in kN/m being displayed as a bar graph with movable pointer.

For reasons of clarity and for an easier tendency or trend indication of the speed of the paper making machine, use is made of the analog vector presentation which is supplemented by the mentioned digital numerical display. The machine parameter 'line-load' is handled similarly by being presented both digitally and also by a bar with a pointer. The corresponding area of machine parameters additionally displays the paper quality which in the illustrated example is "newsprint", the paper weight in $g/m^2$, the input dry content in %, and the stock temperature, i.e. the temperature of the fiber/water mixture at the stock inflow to the press.

The roll parameters comprise the length of covering the number of nips, and information as to upper and lower roll divided into columns. In the case of dual-suction press rolls, two nips are assumed.

The type of covering for the upper roll in the present embodiment is polyurethane while the lower roll has a steel liner. P&J indicates the hardness of the covering as plastomer point, starting from the value steel=zero.

The length of the covering corresponds substantially to the roll length, in which MM indicates the roll diameter including the covering thickness. Flutes and ridges as well as depth and blind-bore diameter as well as the open area of the blind bores are significant to the water carrying capacity and are therefore indicated. As a supplement, the open area of the suction holes is mentioned in percent, the program calculating the sum of the open area for each roll and the $H_2O$ (or water) storage volume of each roll. The $H_2O$ volume of roll is indicated in milliliters per square meter ($ml/m^2$).

For reasons of clarity the screen displays are chosen so that product or initial parameters for roll or felt, on the one hand, and the results, on the other hand, are combined in blocks.

The illustration of the described and indicated results as shown in FIGS. 9–16 will be explained below.

The value of "Trg.A (%)" indicates the calculated outlet dry content. "$H_2O$ a paper" indicates the amount of water squeezed from the paper or the paper web, respectively. "Ges.$H_2O$" in $milliliters/m^2$ indicates the overall accumulated water, and "Ges.Spv" in milliliters/m2 indicates the overall storage volume of rolls and felts in the compressed state. "$H_2O$ differing" means the difference between the storage volume and the accumulated overall water, wherein in the case of a negative water balance the display will flash so that the fact that a limit condition has been exceeded will be easily recognizable.

The other specified results as from gap width to press pulse indicate standard calculation results for press rolls and provide comparative parameters for the possible use of altered rolls. The indicated temperature development of the roll represents a measure of the thermal energy which is released for instance by internal friction upon deformation and flexing work of the roll. The stated coolant quantity in 1/min is based on the thermal energy to be dissipated and takes into account the desired homogeneous temperature characteristic across the roll length.

The connecting lines shown in FIGS. 2 to 8 are meant to show the influences or interactions between the machine and stock parameters, on the one hand, and the results obtained with the respective roll, on the other hand. These connecting lines serve only explanatory purposes, i.e. they are not displayed on the monitor of the computer system.

The arrow illustrations additionally specify the direction of change of the respective parameter or the respective result.

Figure 2:
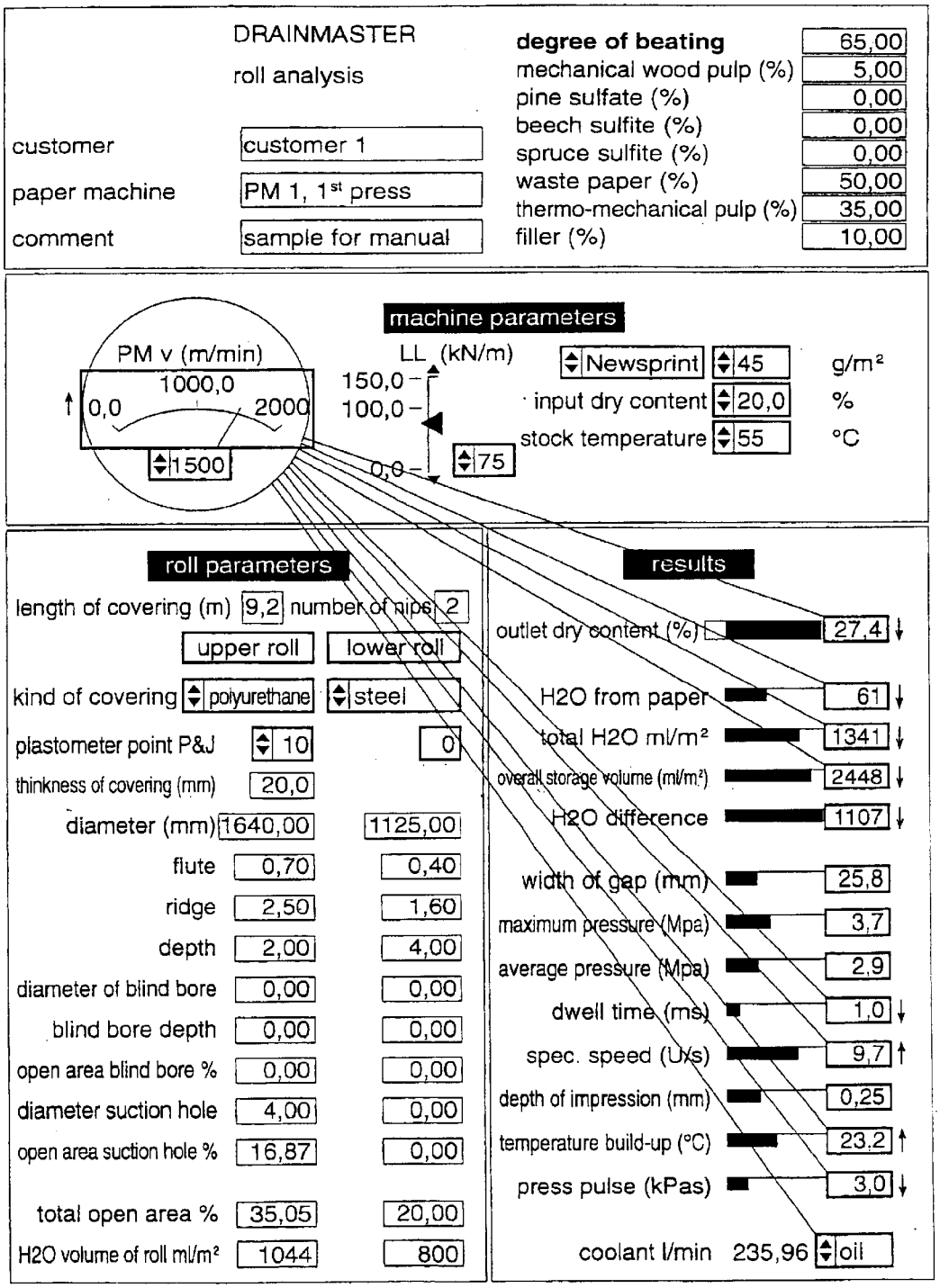

If, for instance, based on FIG. 2 the machine speed is increased, the outlet dry content will be reduced, i.e. the amount of water squeezed from the paper and hence the entire storage volume and also the entire accumulated water as well as the $H_2O$ difference will decrease. An increase in machine speed, i.e. an increase in the number of revolutions, will also lead to an increase in flexing work of the roll which in turn will result in a temperature increase.

Figure 3:
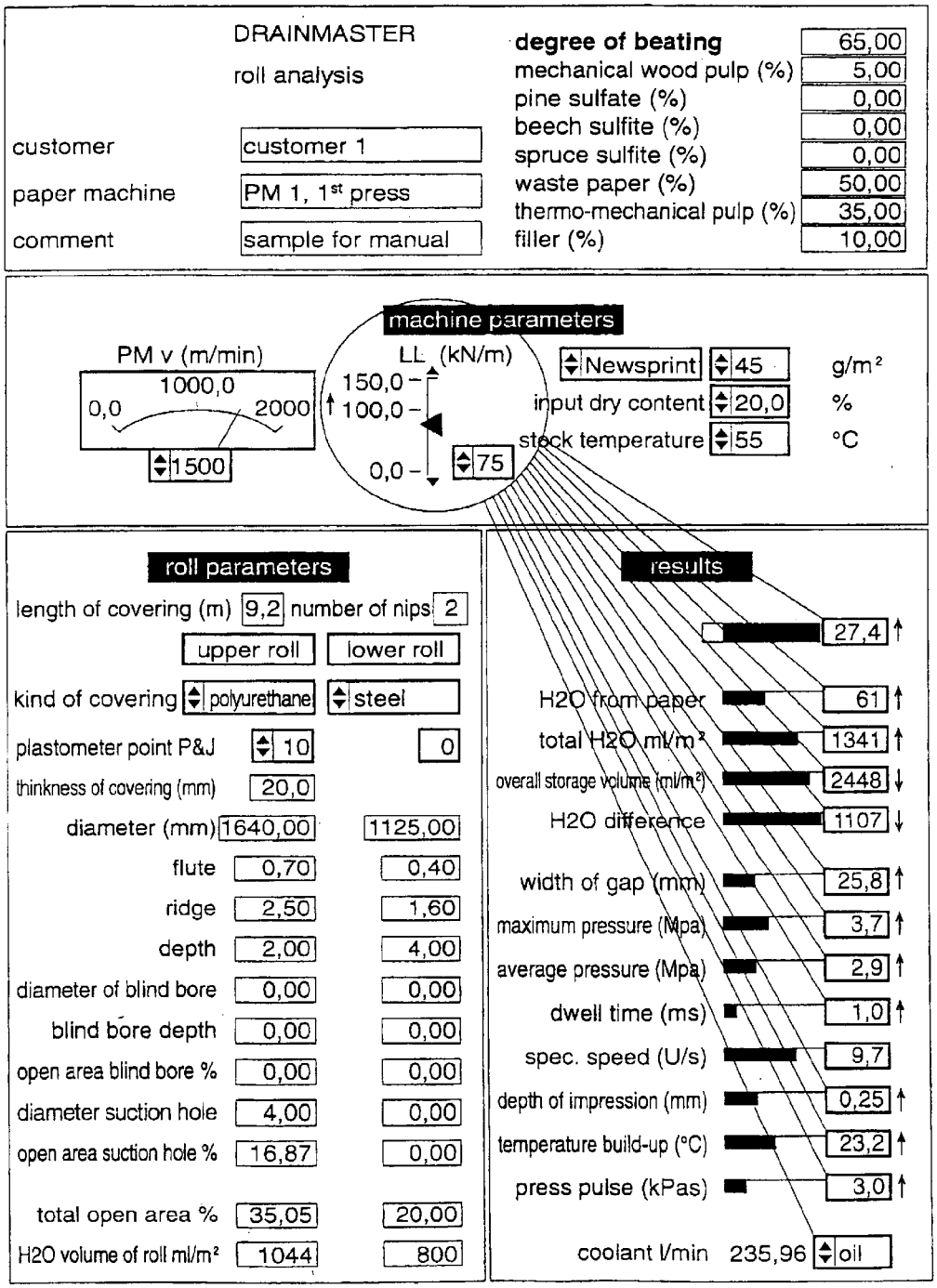
Figure 5:
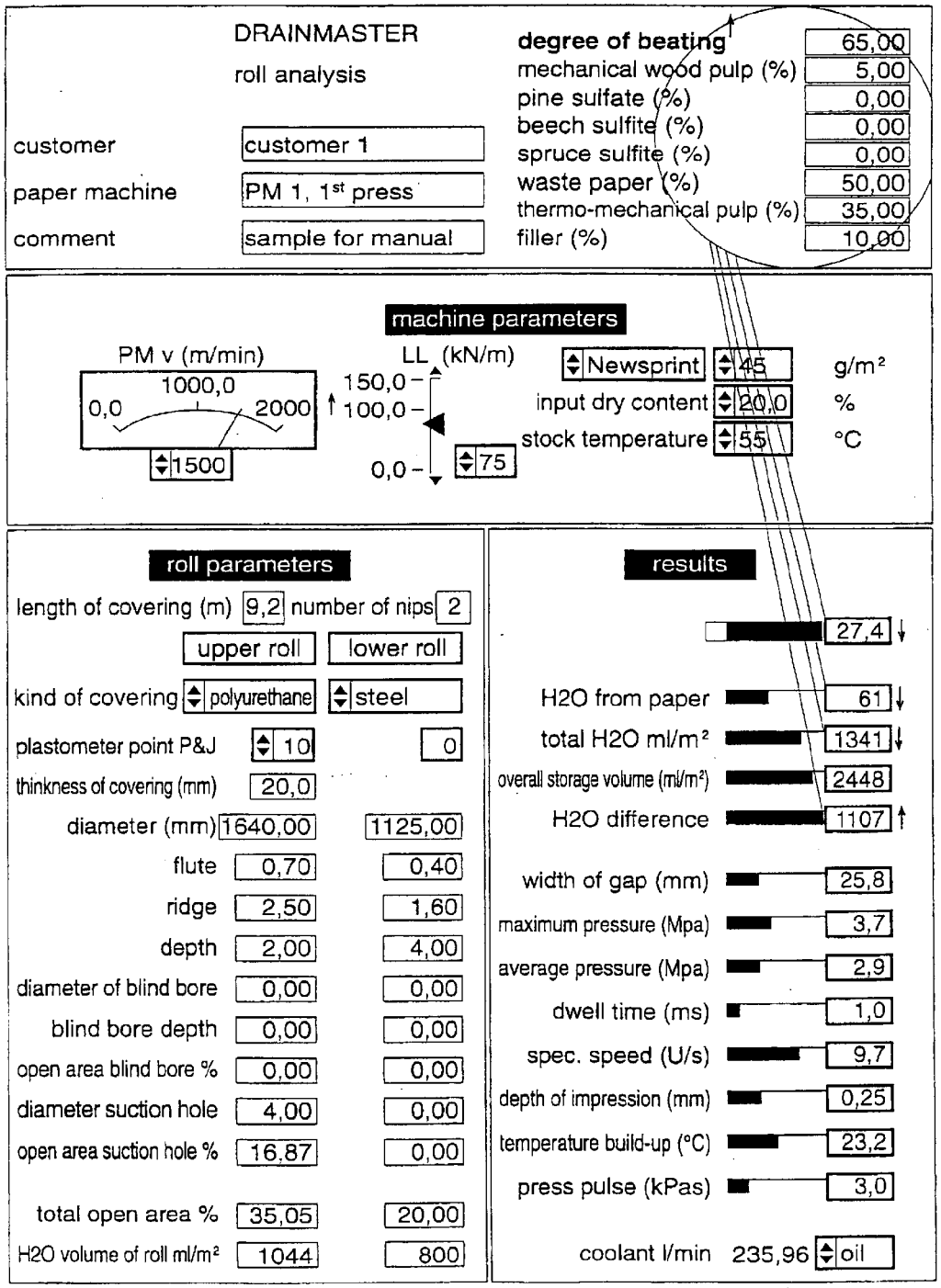
Figure 6:
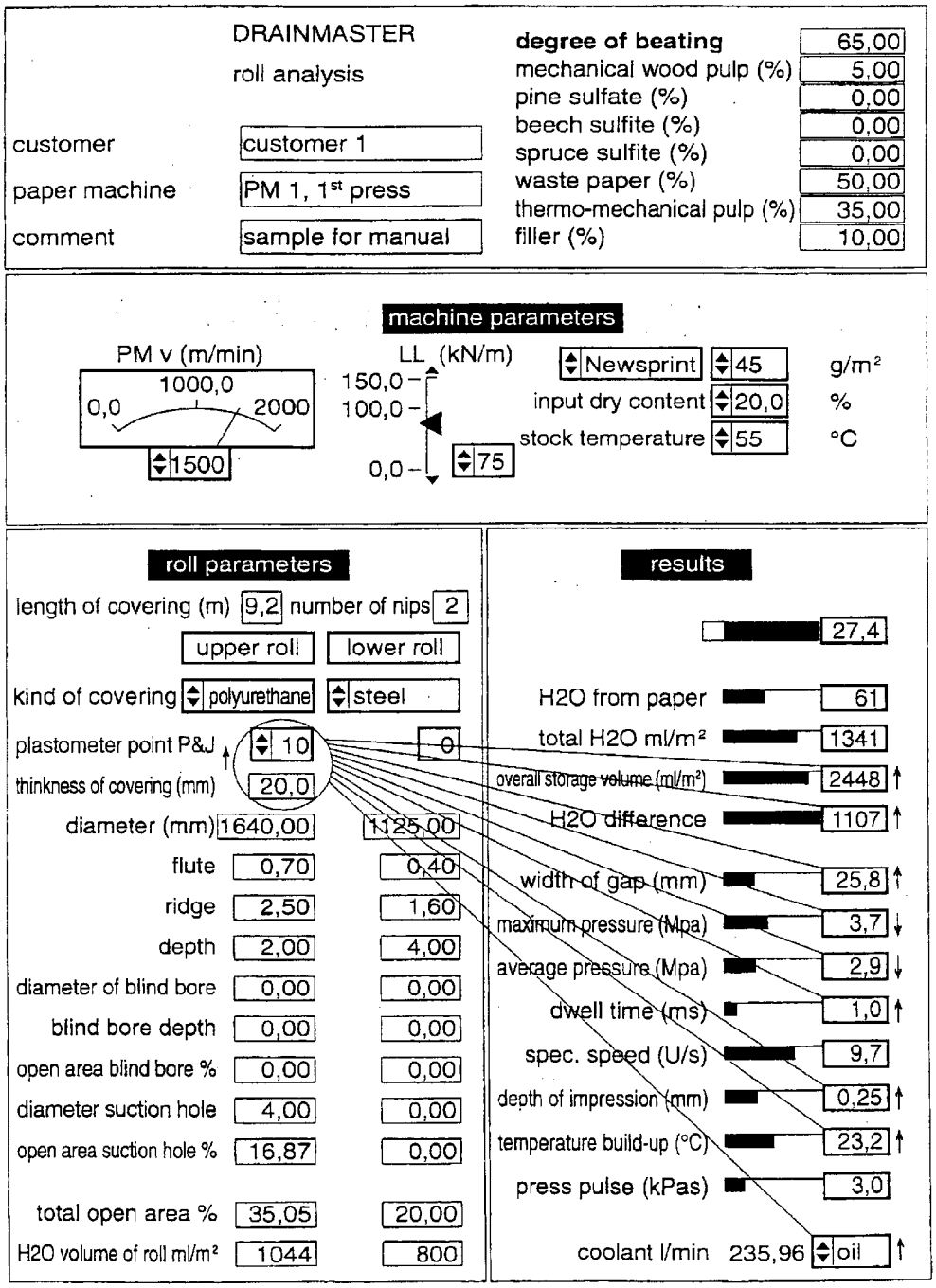
Figure 8:
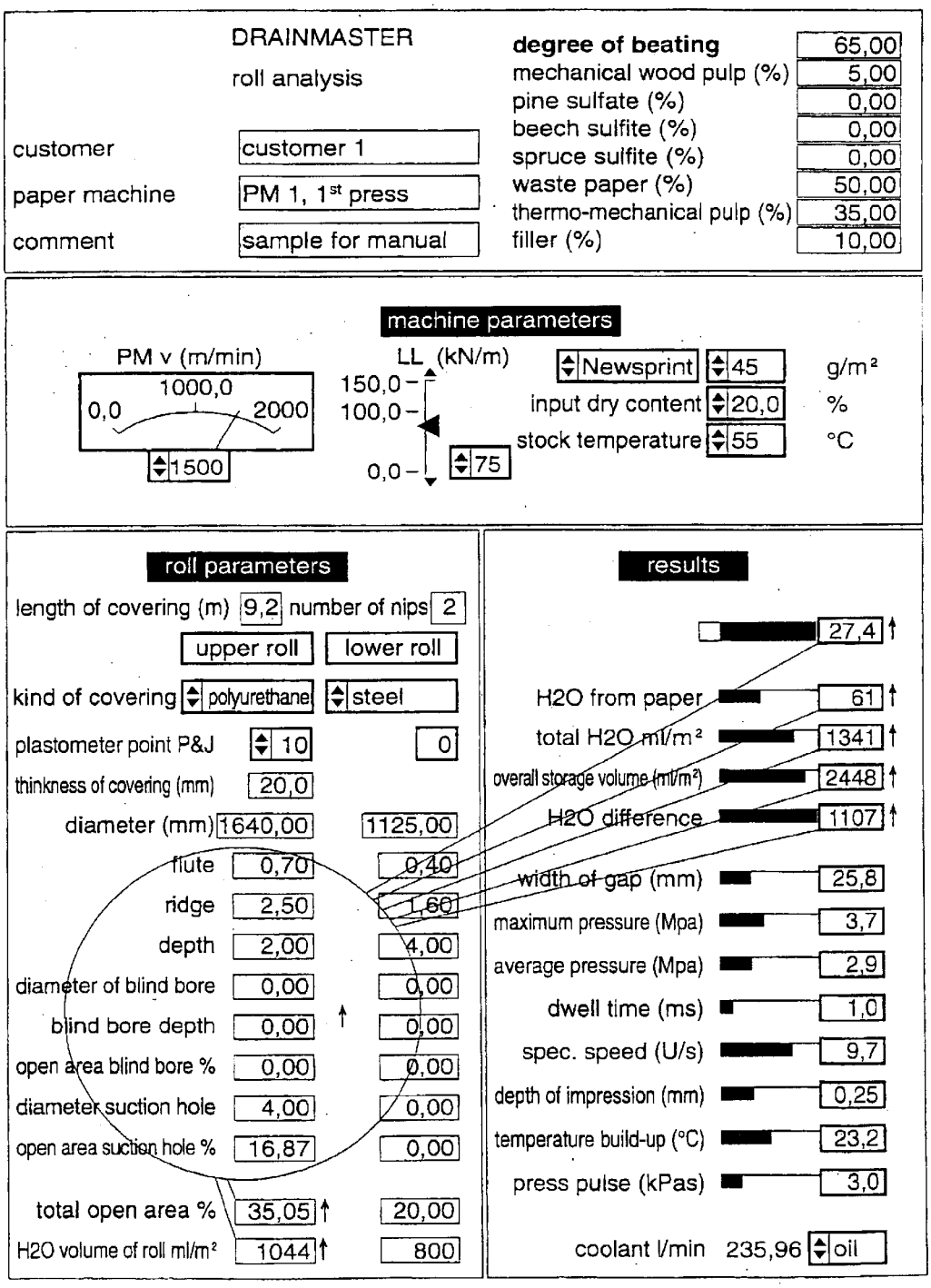

FIG. 3 shows the influence of increased line-load on the roll analysis results; FIG. 4 shows the effects of an altered paper weight, an altered inlet dry content and of altered stock temperature. The effects of the pulp parameters on the dewatering capacity are illustrated in FIG. 5. FIG. 6 serves to symbolically explain the case of an altered hardness of the roll lining or the influence of a varying roll lining thickness. The same applies to FIGS. 7 and 8, the latter clearly showing to what extent the dewatering capacity may be varied by structural measures when water-receiving flutes, ridges and blind bores are formed.

In the embodiment it has been assumed that initially a roll analysis with corresponding presentation is performed. But in this respect it should be noted that for calculating and showing the result of the current dewatering performance of the selected press, reference is made to a felt parameter reading step from the database which step runs in the back-ground. If required, a continuous calculation of the dewatering capacities obtainable with a concrete felt will also be executed in the background prior to and/or simultaneously with displaying the result of the roll analysis so that, without the operator of the program being objectively aware thereof, the mutual influences of felt and roll will be taken into consideration.

In the program or menu item of the roll analysis a change of machine and/or roll parameters of the selected press may now be executed, in which the dewatering performance of the roll/felt combination of the press that was altered on the base of the parameter changes, is continuously calculated anew and displayed at least in part as a trend indication, as has already been explained. As briefly mentioned before, due to the simultaneous presence of the calculation results it is possible to switch at will between roll and felt analyses in order to display the result, and each result display is provided with areas for another change and presetting of machine and roll parameters or machine and felt parameters.

It is possible to change all machine and roll parameters, and to this end reference may again be made by mouseclick direct on the respective parameter areas and for instance the pointer or the bar for machine speed or line-load may be pulled to higher or lower values. Of course, a specification of new parameters by entering a concrete sequence of digits is also possible.

Due to the fact that a change of stock may also be executed or simulated during the process it will be possible to directly investigate the effects of the efficiency of the drying operation of the respective paper making machine in case of altered paper or cardboard stock, so that in this way capacity limits or capacity reserves may be found.

The screen displays of the felt analysis symbolically illustrated in FIGS. 9 to 16 show a similarly clear structure and arrangement as to machine parameters and product specifications in respect of upper and lower felt and the associated results. In the lower section of the drawing it is possible to indicate and read out results obtained under consideration of the simultaneous calculation of the roll analysis, such as outlet dry content, amount of water squeezed from the web, overall storage volume, and overall accumulated water, as well as the control value 'overall water balance'.

It is a particular advantage of the described method that both felt and roll changes can be fully simulated in complete relation to the process, in which due to the use of machine and stock parameters for a press configuration it is possible to specify expected results, i.e. simulated results, extremely quickly so that the method may also be used for direct controlling and monitoring of a paper making machine.

By means of executed learning operations and rewriting of parameters and calculated values in the database in the sense of an updating operation it is possible to store realized or simulated roll/felt combinations not accumulated so far for use in future applications, so that a further reduction in computing time and the time for displaying results is achieved in subsequent operations.

Basically, roll and felt analyses are run together, i.e. simultaneously, in the background, and obtained results may be stored in the database at corresponding global variables. However, for reasons of clarity only a corresponding worksheet of the felt or roll analysis is shown, although a joint presentation of particularly typical values is also conceivable.

Preferably, the calculated results are presented on a monitor of the computer system in different graphic and/or colored form, wherein the product-related results are displayed in a first corresponding form, for instance by red bars, the water-related results are displayed in a second corresponding form, for instance by blue bars, and the alterable input parameters are displayed in a third corresponding form, for instance by black characters on white areas.

Hereinbelow, the felt analysis performed with FIGS. 9 to 16 will be described also in respect of its interconnecting parameters and influencing effects (connecting lines and arrow presentations).

As in the roll analysis, an upper section of the screen display is related to the paper making machine and the stock parameters. In a further common area, the machine speed and the line-load as well as selected stock parameters are again specified machine parameters, and in this respect reference should be made to the explanations concerning the roll analysis.

Upper and lower felt are then verified in columns as to type and Scanpro. Scanpro means the absolute moisture content of the felt as it exits a tubular suction assembly and is given in terms-of $ml/m^2$. Moreover, Scanpro is used to determine the absolute moisture content of the felt when the press is operating.

The Scanpro values are measured values which may be obtained, for instance, with a so-called Scanpro press tuner.

The term felt $g/m^2$ refers to the calculated overall weight of the felt, and the term GG $g/m^2$ refers to the calculated weight of the base fabric. The number of needles corresponds to the respective standard setting of the given system, the fiber blends being indicated by denier. For instance, "%1.Fa" is the proportion of the first fiber in percent. "Lag" refers to the number of non-woven layers per blend, and "G/Lag" refers to the weight of each layer of a blend.

"RS-vacuum" refers to the measured tube suction vacuum value upon start-up of the paper making machine. The barpointer graph "days" verifies the expected calculated operating time of the felt in terms of days. This calculated operating time result is contained or displayed in the respective result blocks.

The felt quotient results from the measured Scanpro value per overall felt weight.

"H2O Vol.new" corresponds to the storage volume of the new base fabric under a given line-load, wherein "H2O-operating days" indicates the storage volume of the base fabric in the course of the operating time. "Per" in $l/m^2*min$ refers to the water permeability of the press felt which varies with the operating time.

The resistance to flow of the press felt is likewise dependent on the operating time and will, for instance, increase due to filling or clogging of the felt. In this respect it is to be noted that the resistance to flow is one of the limit conditions in the dewatering process. The resistance to flow in the felt is dependent, for instance, on the stratification of fibers, the preliminary compacting, the non-woven covering, the storage volume, the weight of the base fabric, the storage volume of the press roll along the flow paths, the hydraulic pressure, and the amount of water within the felt. When a situation occurs where a short nip dwell time is no longer sufficient to drain the amount of water in the felt through the non-woven, or when the hydraulic pressure in the roll nip becomes excessive due to the roll design having excessively long flow paths and insufficient storage volume, the roll/felt combination or the entire wet press system, respectively, will be hydraulically overloaded. An early recognition of such overload states can prevent undesirable vibrations, too short service life, and is useful for an early detection of potential felt breakage. This situation can be symbolized separately, for instance, by a flashing presentation of the bar characteristic or by numerically indicating the resistance to flow.

In addition to the actual drainage of moisture, the measures taken towards dewatering both by means of suction tube and nip drainage are also useful for cleaning the felt and removing dirt particles, respectively, so that the service life will be prolonged.

Figure 9:
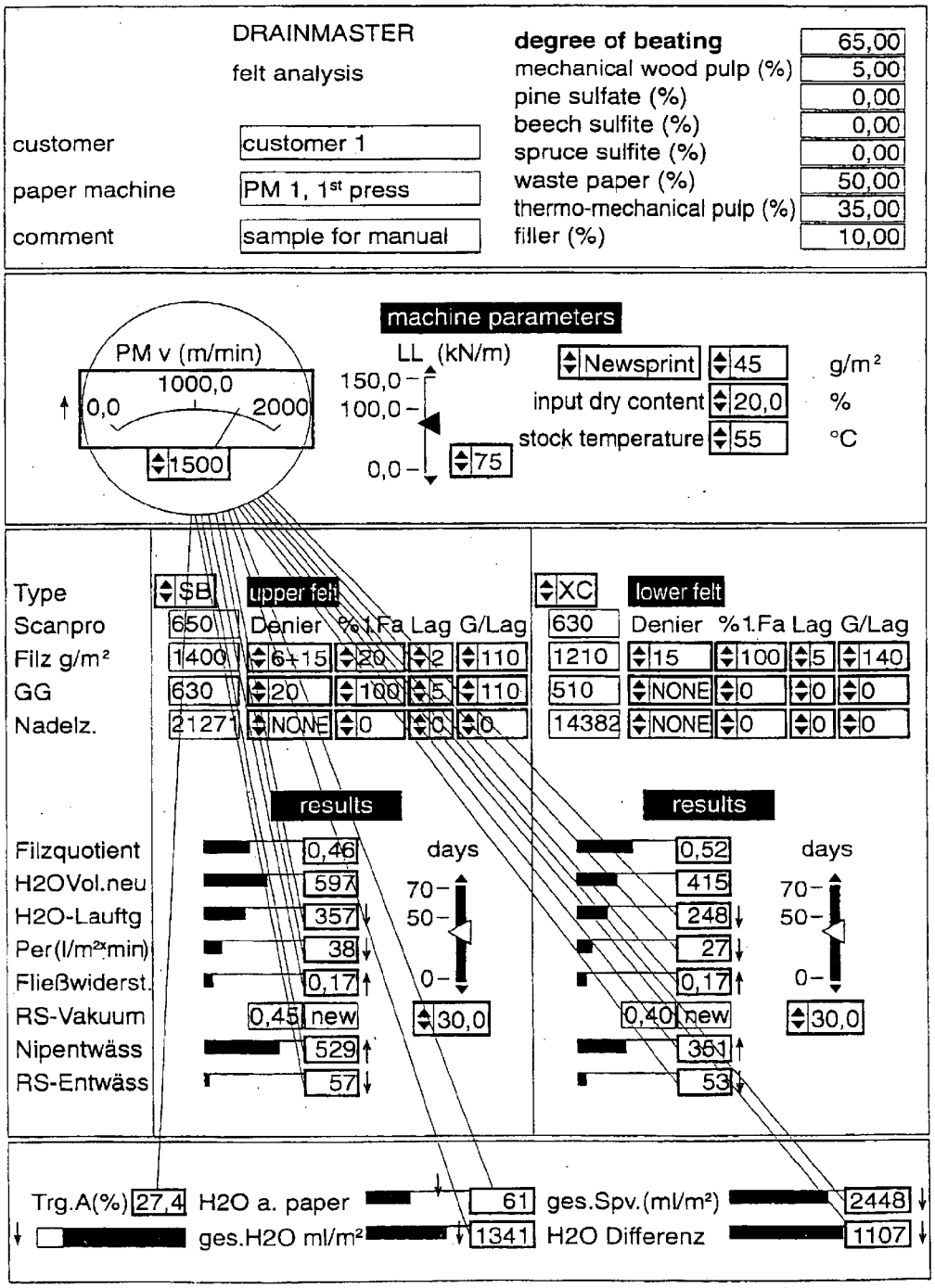
FIGS. 9 to 16 are screen presentations of the felt analysis including the symbolic link between influencing parameters and results.

The connecting lines included in the felt analysis illustrated in FIG. 9 show in detail the relationships in case of a change of machine speed as related to the dewatering capacity and certain calculation results relating to the felt.

Figure 10:
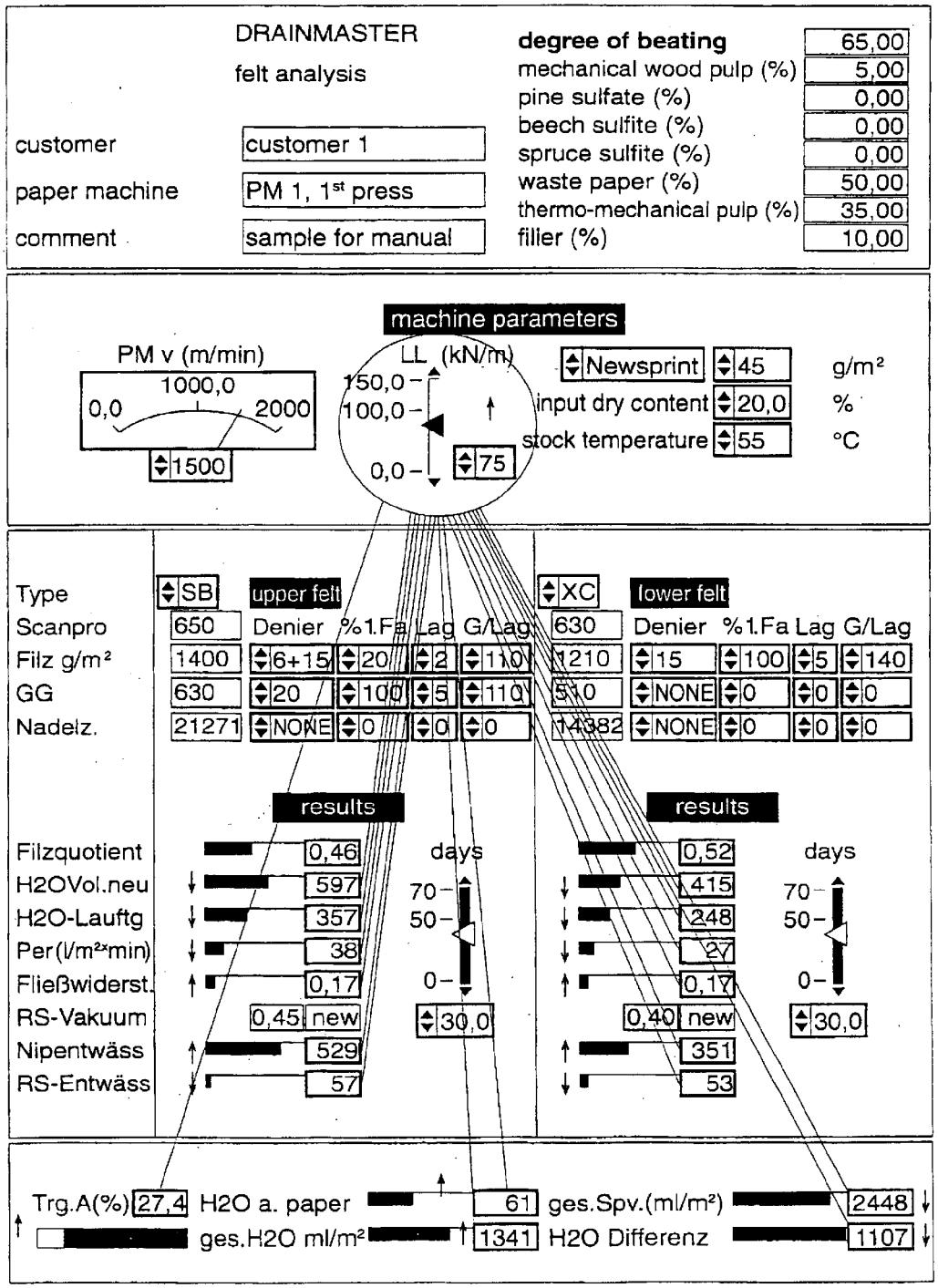

FIG. 10 illustrates the interaction between increased line-load and calculation results of the felt analysis as well as the dewatering capacity.

Figure 11:
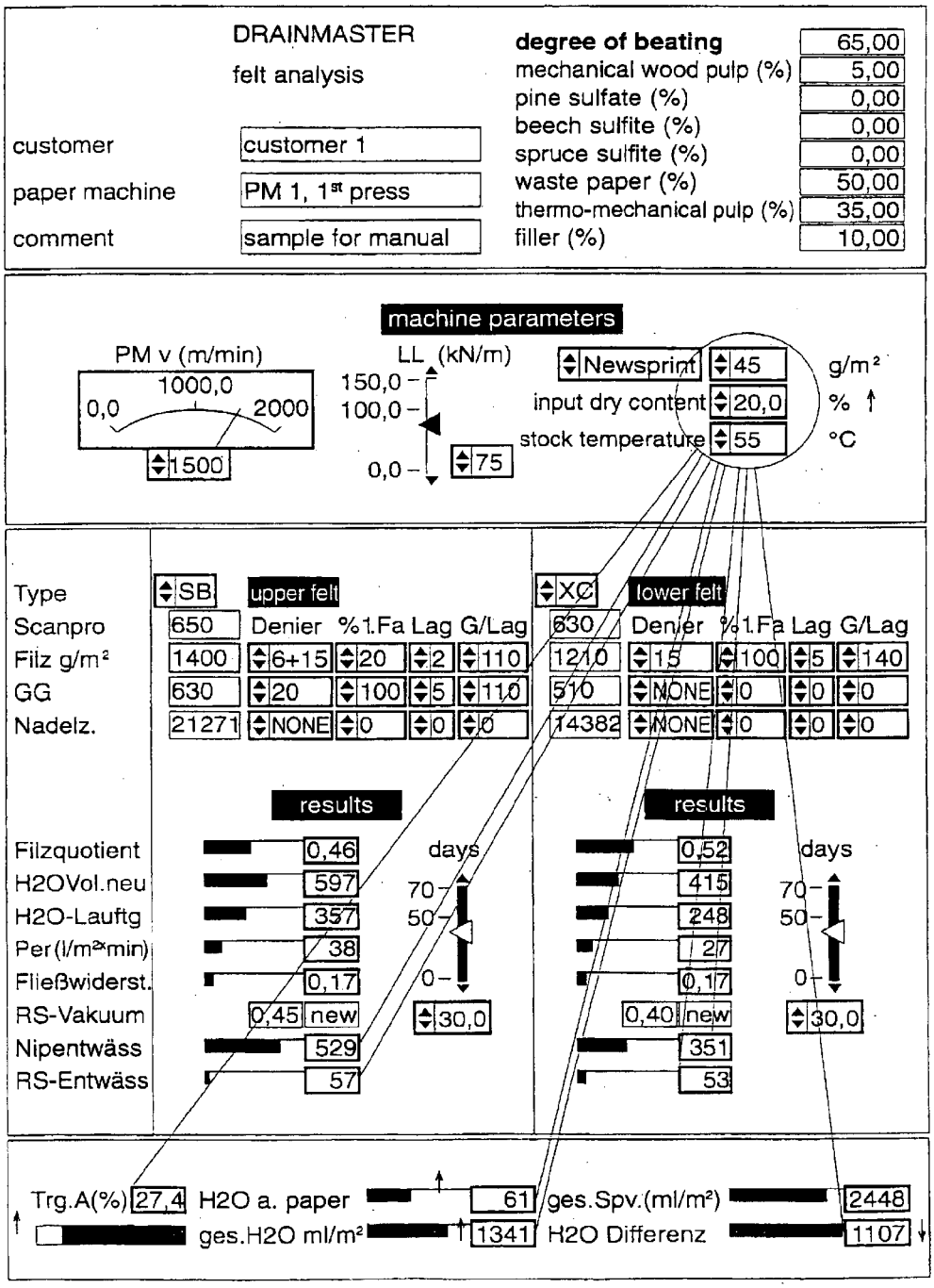
Figure 12:
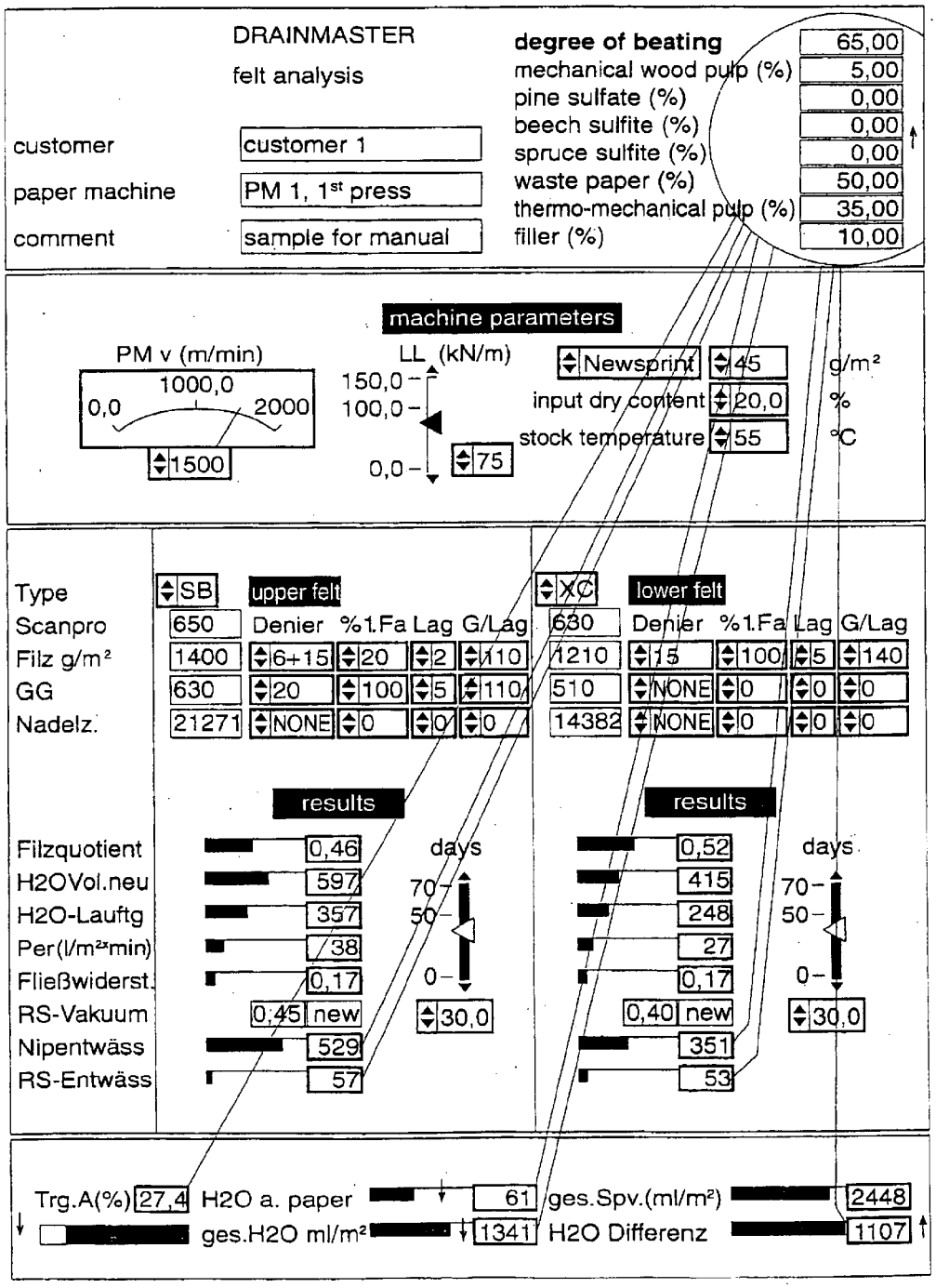

The interactions between changed stock parameters and the dewatering capacity as illustrated in FIG. 11 are in correspondence with those illustrated in FIG. 4. The same applies to the effects of a change in pulp parameters as illustrated in FIGS. 12 and 5, respectively.

Figure 13:
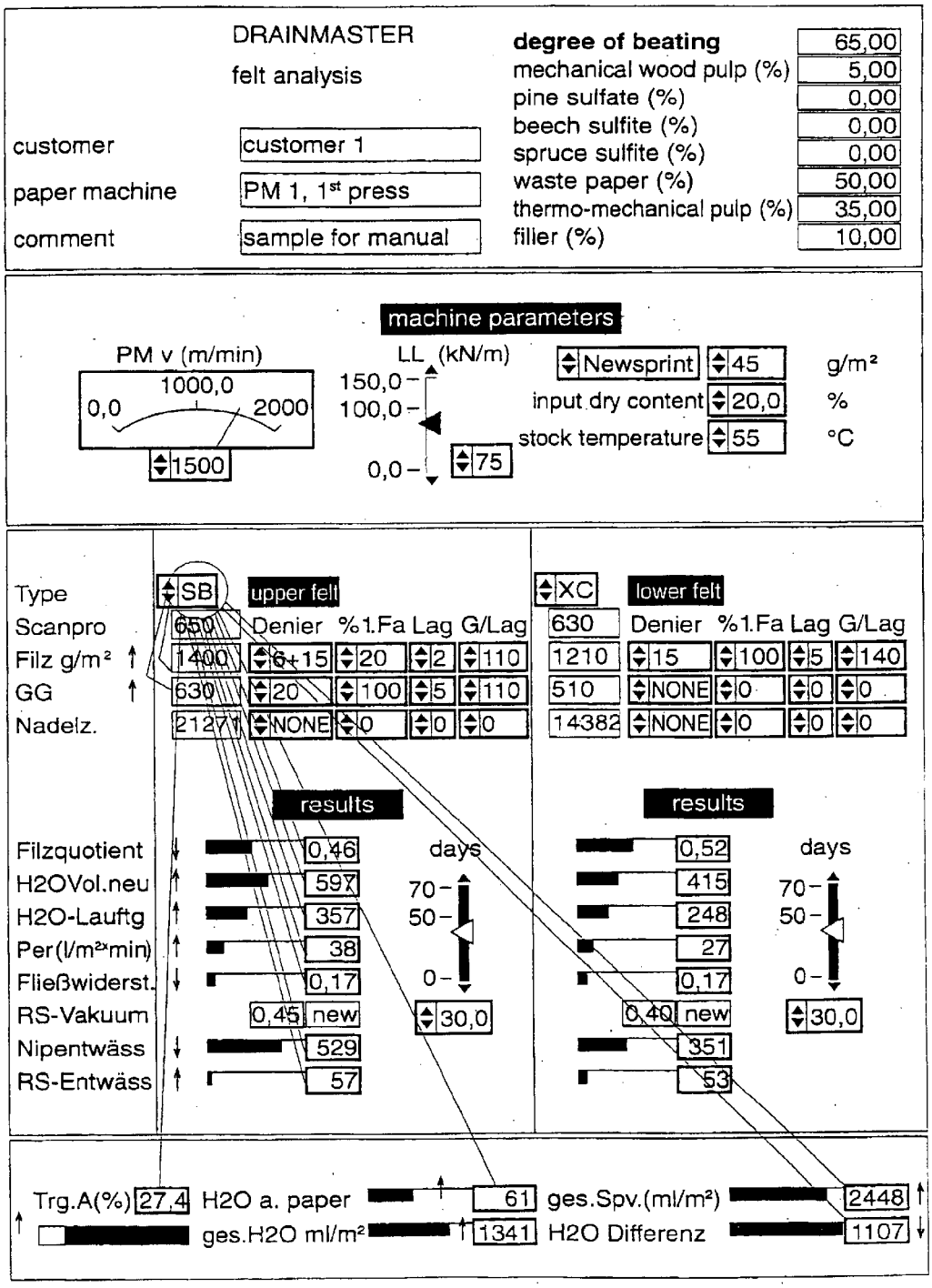
Figure 14:
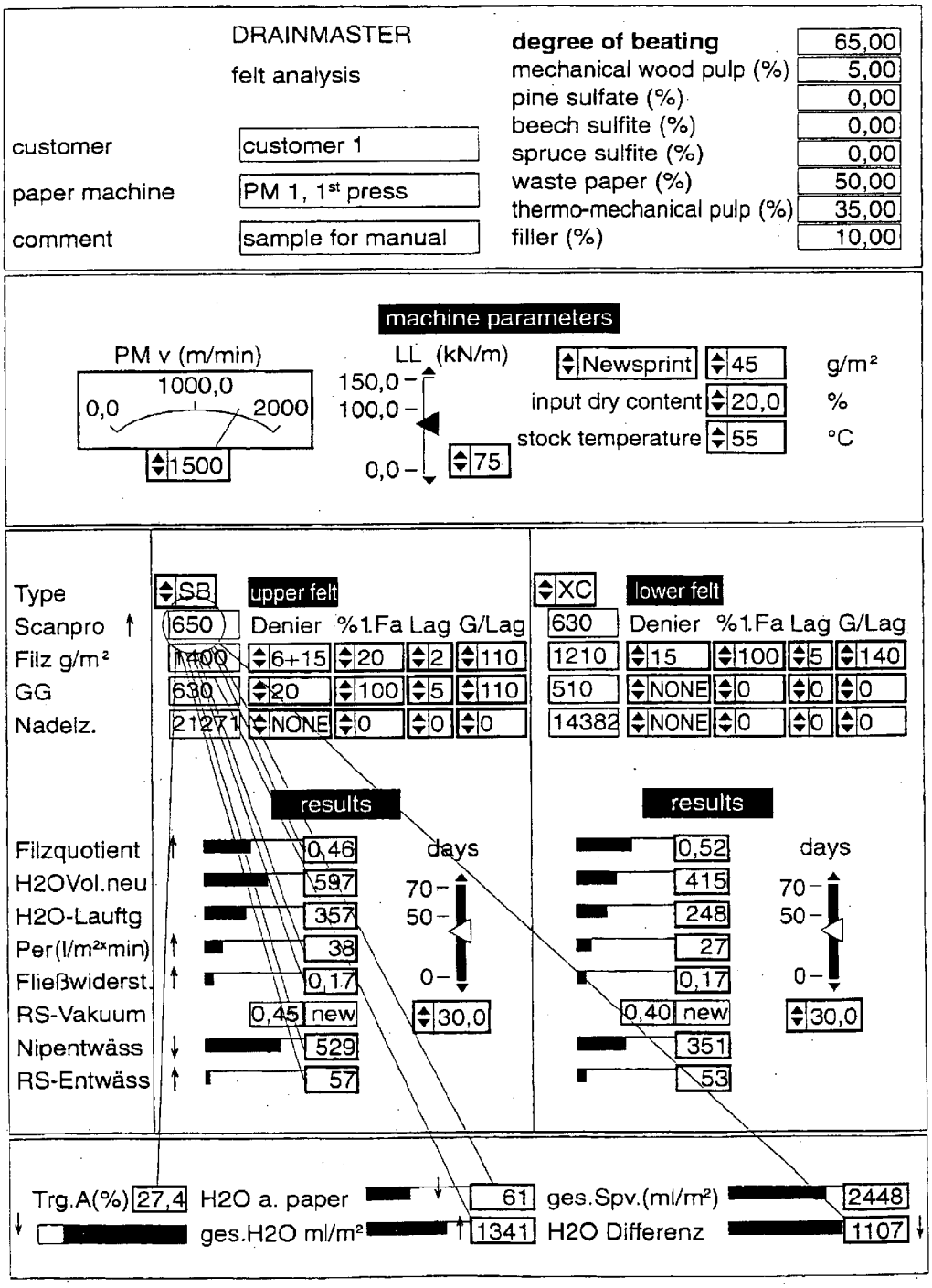
Figure 15:
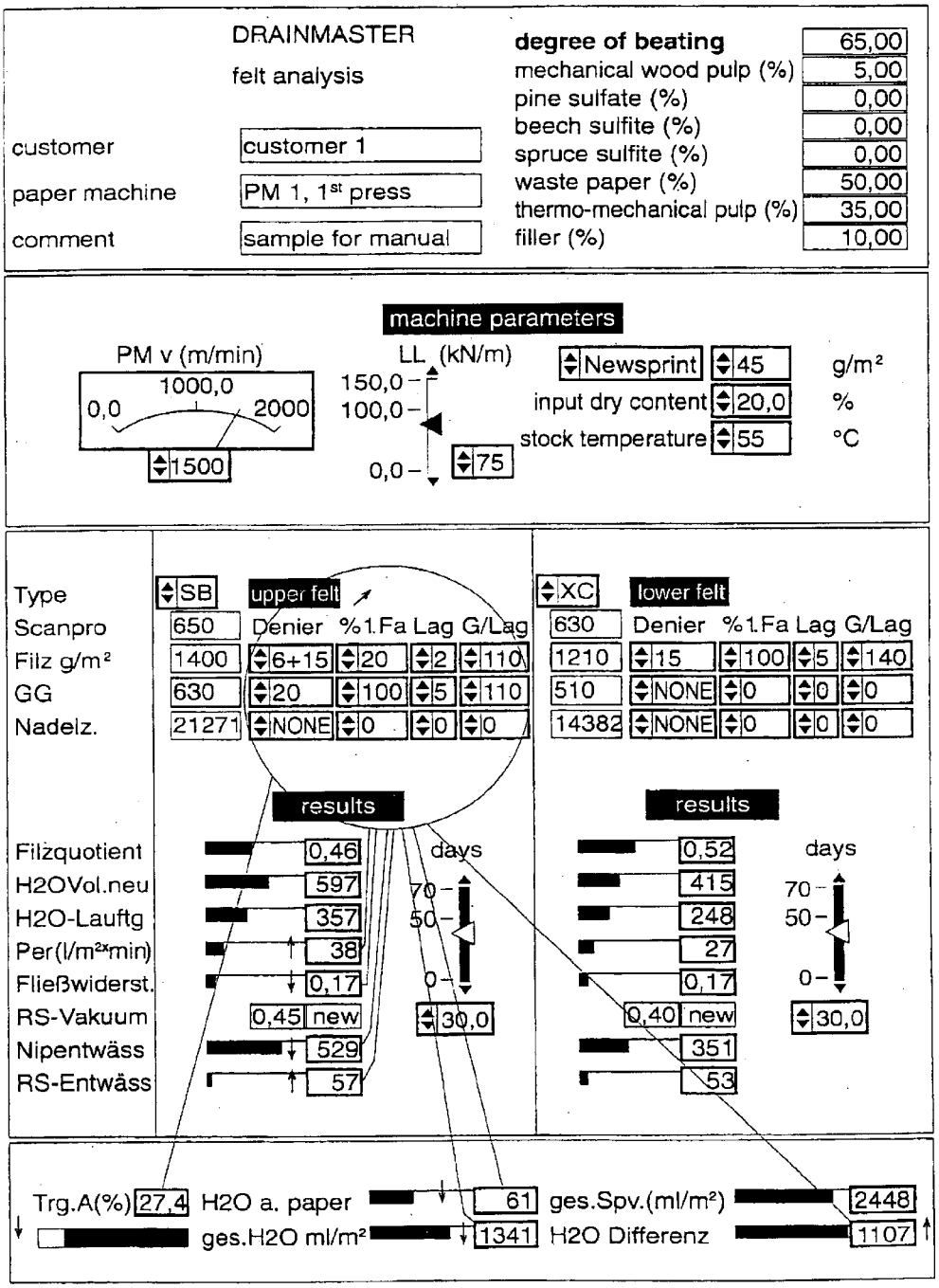
Figure 16:
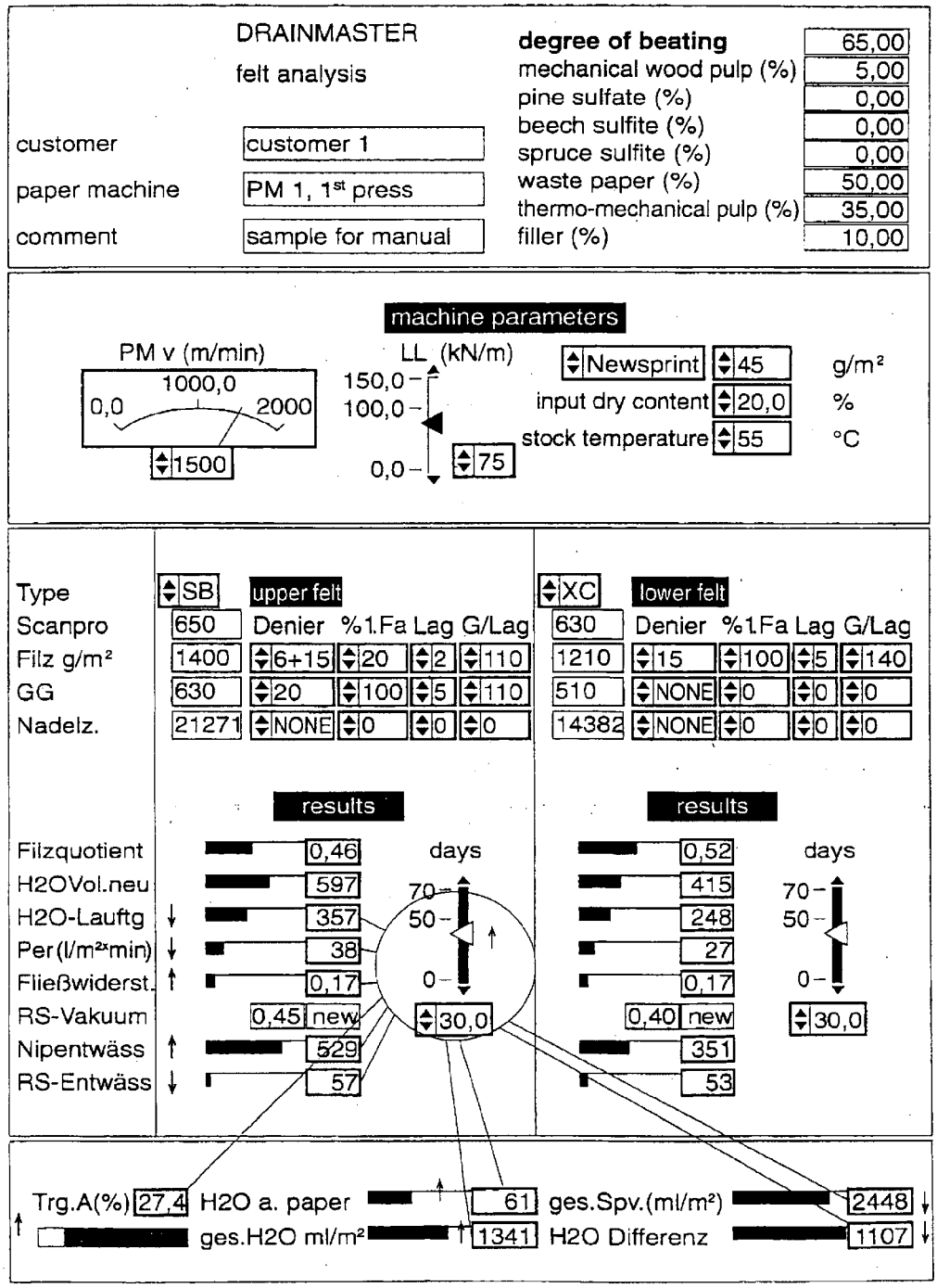

As expected, a change of the respective used type of felt will lead to different resistances to flow and a change in storage volume during the service time of the felt, as illustrated in FIG. 13. As will be apparent from FIG. 14, increased values of the absolute moisture content of the felt upon exit from the suction tube unit will result, among other things, in an actually undesirable reduction in the overall water balance. Mutual effects between the fiber blends and the dewatering capacity are illustrated in FIG. 15. FIG. 16 basically explains the interaction between typical parameters of the dewatering capacity and the felt service life in terms of days.

As described above, the program may alternately switch between roll and felt analysis as desired, wherein the already existing input values and obtained calculations will not be affected so that the most current values entered as the latest ones will remain in the system. The stock data or stock parameters may be varied from both the roll analysis and the felt analysis.

When the analysis of the press configuration for a press combination has been completed it is possible by activating a tab "next press" with a mouse click to fetch and display a system proposal for roll and press felts for the newly selected press. The predefined machine speed, paper grade, stock temperature and all other stock parameters will be retained also for said next press until modifications of these, quasi overriding, influencing parameters are made.

In this way an overall analysis of the press configuration can be performed successively, and it is possible to have a printout of the results in the form of a journal. Likewise, for controlling and monitoring a press it is possible to continuously monitor particularly critical limit values and/or to directly influence the process, i.e. the control of the paper making machine.

With the present method it is therefore possible to determine the weight of the base fabric and also the overall weight for quite different kinds of felt types, to determine the storage volume of the felt under operating loads, to determine a variation of the storage volume as related to service life, and to specify resistances to flow by flow variation and service time. Similarly, it is possible to determine whether, and to what extent, a change in felt storage volume exists due to a change in the roll hardness. Ultimately, it is possible in a simple way to perform a calculation of the water balance, and in this respect reference may be made to the influence of the nip dwell time and the maximum pressure acting on the press felt. In a similarly clear way it is possible to compare the resistance to flow in the felt and the overall storage volume in the press.

Due to the distinctive kind of graphic presentation in the form of bars and/or vector diagrams with additional concrete numerical display it is easily possible to determine the effect of an increase in stock temperature, a change in line-load, a change in speed, and/or a change in the degree of beating of the feed, on the ultimate dry content.

From the foregoing it will be apparent that the method in accordance with the embodiment is not merely useful for choosing the optimum press configuration but by way of a roll/felt analysis also allows optimum determining of the combination within the press configuration as related to a corresponding combination of materials. By means of simulation steps, i.e. by observing any changes that were possibly made or have to be made or may occur, expected results may be previously determined and utilized for control and/or monitoring purposes. If, for instance, a negative overall water balance occurs upon simulation, a controlled variation may be made by an alteration of the menu item "altering machine or stock parameters", while all other parameters are retained so that the interactions between the individual components of the press system are taken into account in a way close to the real conditions. Ultimately, it is possible via an auto-running operation of changing and setting the machine/roll and/or machine/felt parameters for the system to automatically specify roll/felt combinations and/or non-woven build-ups of the felt having a predetermined maximum dewatering capacity.

What is claimed is:

1. A method of designing and/or visualizing at least one roll/felt combination in a wet press of a paper or cardboard making machine comprising:

selecting a press configuration from a set of different press configurations offered by a computer system under consideration of the case of use and the desired paper or cardboard quality;

selecting one of the presses of the respective press configuration while relevant machine and roll initial parameters of the selected press are read from a standard data base and displayed;

calculating and displaying the result of the current dewatering performance of the selected press by reference to a step of reading felt parameters from the standard data base, said reading step being executed in the background;

changing machine and/or roll parameters of the selected press;

continuously calculating and displaying the dewatering performance of the roll/felt combination;

indicating a trend of the dewatering performance by displaying an arrow icon, pointing up or down, adjacent to the calculated and displayed results;

wherein due to the simultaneous existence of the calculated results, it is possible to switch at random between roll analysis and felt analysis in order to display the results; and wherein each display of results is provided with areas for renewed changing and setting of machine and roll parameters or of machine and felt parameters.

2. The method as claimed in claim 1, wherein the continuous changing and setting of machine/roll and/or machine/felt parameters is performed automatically with the object of specifying a roll/felt combination and/or a non-woven structure having a predefined maximum dewatering capacity.

3. The method as claimed in claim 1, wherein upon selection of a further press of the respective press configuration, system-proposed data for the further press are read from the standard database, wherein important machine parameters as well as stock parameters governing the quality of the paper or cardboard will be retained and taken over as overriding influencing parameters until a new press configuration is selected.

4. The method as claimed in claim 1, wherein the standard database contains data associated with operational parameters for all press configurations which data may be altered in the course of the analysis, wherein new standard data obtained by calculations based on new machine parameters, stock parameters, roll parameters and/or felt parameters may be stored.

5. The method as claimed in claim 4, wherein obtaining new standard data comprises:

simulating operations of at least one of the press configurations; and storing data associated with operational parameters of the at least one simulated press configuration in the standard database.

6. The method as claimed in claim 1, wherein for the purpose of actually controlling a paper or cardboard machine, reference is made to a process-related simulation of the performance of the roll/felt combinations of the wet press, wherein current machine and roll parameters in particular are adjusted on the basis of a previously determined machine covering.

7. The method as claimed in claim 1, wherein the machine, roll, and felt parameters as well as the calculated results may be presented on a monitor of the computer system in different graphic and/or colored forms.

8. The method as claimed in claim 7, wherein, when presenting the dewatering performance of the respective press, the product-related results are displayed in a first corresponding form, the water-related results are displayed in a second corresponding form, and variable input parameters are displayed in a third corresponding form.

9. The method as claimed in claim 1, wherein said machine and stock parameters comprise:

machine speed, line-load, paper quality, weight of paper, input dry content, stock temperature.

10. The method as claimed in claim 1, wherein the roll parameters comprise:

length of covering, type of covering, number of nips, plastometer points indicating the hardness of the covering, thickness of the covering, diameter inclusive of roll covering, flutes, ridges and blind bores as well as suction hole diameters.

11. The method as claimed in claim 1, wherein the felt parameters comprise:

type and kind of base fabric, measured value of the absolute moisture content of the felt, overall weight and the weight of the base fabric, fiber blends and the number of non-woven layers per blend as well as the weight per layer of a blend, and measured value of the vacuum of the tubular suction unit upon startup of the paper machine.

12. The method as claimed in claim 1, wherein the calculated and displayed results comprise:

outlet dry content, volume of water squeezed from the paper web, overall volume of water, overall storage volume, difference between overall storage volume and overall volume of water, amount of coolant required for cooling the rolls, overall weight of felt, storage volume of a base fabric permeability of the felt to water and resistance to flow of the felt.

13. The method as claimed in claim 4, wherein obtaining new standard data comprises:

operating at least one of the press configurations; and storing data associated with operational parameters of the at least one operated press configuration in the standard database.

* * * * *